US005628131A

United States Patent [19]

Chasen

[11] Patent Number: 5,628,131

[45] Date of Patent: May 13, 1997

[54] STEAM SURGE SYSTEM FOR AN ELECTRIC STEAM IRON

[75] Inventor: James E. Chasen, West Haven, Conn.

[73] Assignee: Black & Decker Inc., Newark, Del.

[21] Appl. No.: 573,985

[22] Filed: Dec. 18, 1995

[51] Int. Cl.[6] ..... D06F 75/18

[52] U.S. Cl. ..... 38/77.83

[58] Field of Search ..... 38/77.83, 88, 77.3, 38/77.8

[56] References Cited

U.S. PATENT DOCUMENTS

| | | | |
|---|---|---|---|
| 2,384,839 | 9/1945 | Kistner | 38/77 |
| 2,637,126 | 5/1953 | Fitzsimmons | 38/77 |
| 3,304,636 | 2/1967 | Vieceli et al. | 38/77 |
| 3,711,972 | 1/1973 | Risacher | 38/77.83 |
| 3,820,259 | 6/1974 | Flowers | 38/77.5 |
| 3,828,452 | 8/1974 | Eaton et al. | 38/77.83 |
| 3,872,613 | 3/1975 | Davidson et al | 38/77.83 |
| 3,919,793 | 11/1975 | Toft et al. | 38/77.83 |
| 4,077,143 | 3/1978 | Walker et al. | 38/77.83 |
| 4,091,551 | 5/1978 | Schaeffer | 38/77.83 |
| 4,240,217 | 12/1980 | Schwob | 38/77.83 |
| 4,414,766 | 11/1983 | Schwob | 38/77.83 |
| 5,115,117 | 5/1992 | Amiot et al. | 219/254 |
| 5,279,054 | 1/1994 | Chasen | 38/77.7 |
| 5,307,573 | 5/1994 | Watkins | 38/77.8 |
| 5,345,703 | 9/1994 | Farrington et al. | 38/77.83 X |

*Primary Examiner*—Ismael Izaguirre
*Attorney, Agent, or Firm*—Barry E. Deutsch

[57] ABSTRACT

An electric steam iron with a soleplate, a water reservoir, a primary steam generating system and a surge steam generating system. The soleplate has a first primary steam generating area and a separate second surge steam generating area. The second surge steam generating area is located above and along the heating element in the soleplate. The second surge steam generating area substantially surrounds the first primary steam generating area and both areas have exits into a rear chamber. The rear chamber is connected to a steam distribution chamber for allowing the steam to exit the bottom of the soleplate.

22 Claims, 4 Drawing Sheets

STEAM SURGE SYSTEM FOR AN ELECTRIC STEAM IRON

BACKGROUND OF THE INVENTION

1. Field of the Invention

The present invention relates to electric steam irons and, more particularly, to a steam surge system.

2. Prior Art

U.S. Pat. No. 5,279,054 discloses a steam iron with a sloped bottom floor of a boiler and a surge steam channel on top of a heater that exits into the boiler. U.S. Pat. No. 4,091,551 discloses a steam iron with separate main steam and surge steam passages. U.S. Pat. No. 4,414,766 discloses a surge steam generation point located above a heating element. The following U.S. patents also disclose various irons with steam generation systems:

| | |
|---|---|
| U.S. Pat. No. 3,304,839 | U.S. Pat. No. 2,637,126 |
| U.S. Pat. No. 3,304,636 | U.S. Pat. No. 3,711,972 |
| U.S. Pat. No. 3,820,259 | U.S. Pat. No. 3,828,452 |
| U.S. Pat. No. 3,872,613 | U.S. Pat. No. 3,919,793 |
| U.S. Pat. No. 4,077,143 | U.S. Pat. No. 5,115,117 |
| U.S. Pat. No. 5,307,573 | |

SUMMARY OF THE INVENTION

In accordance with one embodiment of the invention, an electric steam iron is provided having a soleplate with a heating element, a water reservoir, and means for depositing water from the reservoir onto the soleplate at a first location for ordinary steam generation and at a second location for surge steam generation. The improvement comprises the soleplate having a first primary steam generating area with the first location thereat and a substantially separate second surge steam generating area. The second location is located in the second surge steam generating area above the heating element. The second surge steam generating area includes a recessed pocket next to the second location for dampening pressure from steam generation at the second location.

In accordance with another embodiment of the present invention a surge steam generating system in an electric steam iron is provided comprising an elongate surge steam generating path and a balancing rib. The surge steam generating path is located above and along a heating element of the iron and includes two exits. The balancing rib extends partially across the path on a first side of an entry point of water into the path. The entry point of water is located at a non-centered position of the length of the path such that a length of the path on the first side of the entry point is shorter than a length of the path on an opposite second side of the entry point. The rib is suitably sized, shaped, and positioned relative to the entry to control flow of water and steam therepast such that steam exits the two exits substantially uniformly.

In accordance with another embodiment of the present invention a soleplate for an electric steam iron is provided comprising a first steam generating chamber, a second steam generating chamber and a third steam distribution chamber. The first steam generating chamber is for generating primary steam. The second chamber is separate from the first chamber and substantially surrounds the first chamber. The second chamber has a general "U" shape and is located above and along a portion of a heating element in the soleplate for generating surge steam. The third steam generating chamber substantially surrounds the second chamber and has holes extending through the soleplate to a bottom surface of the soleplate.

In accordance with another embodiment of the present invention an electric steam iron is provided comprising a soleplate and a thermostat. The thermostat is connected to a boss on the soleplate. The soleplate has a primary steam generation area with the boss being located, at least partially, in the primary steam generating area. A bottom surface of the primary steam generating area has an inclined section such that water deposited into the primary steam generation area is directed towards the boss for controlling cycling of the thermostat.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
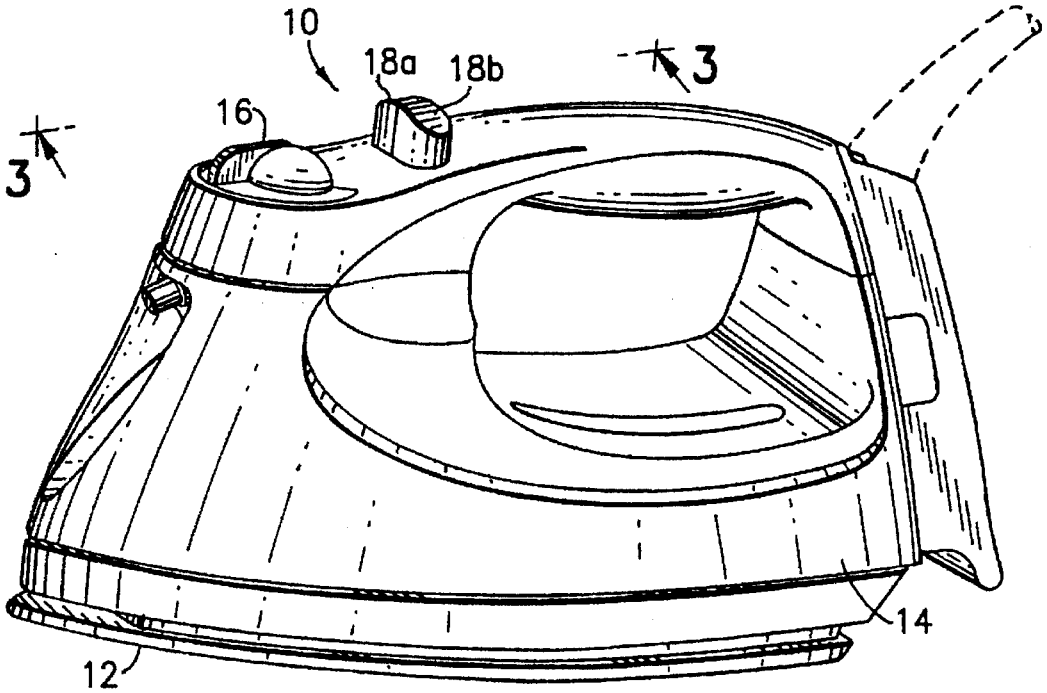
FIG. 1 is a perspective view of an electric steam iron incorporating features of the present invention.

Referring to FIG. 1, there is shown an electric steam iron 10 incorporating features of the present invention. Although the present invention will be described with reference to the single embodiment shown in the drawings, it should be understood that the present invention may be incorporated into various different types of irons. In addition, any suitable size, shape or type of elements or material could be used.

Figure 2:
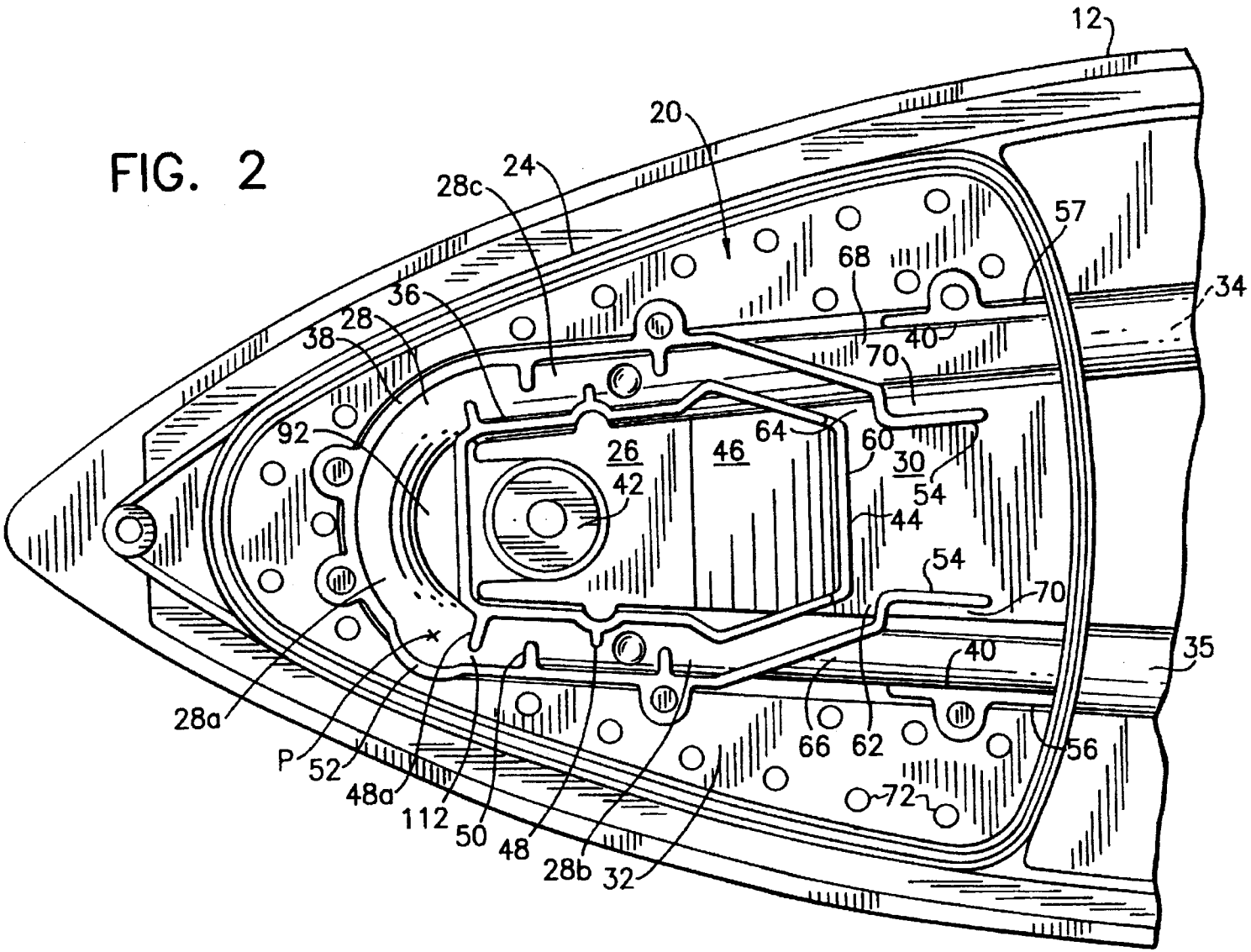
FIG. 2 is a plan top view of the front of the soleplate of the iron shown in FIG. 1.
Figure 3:
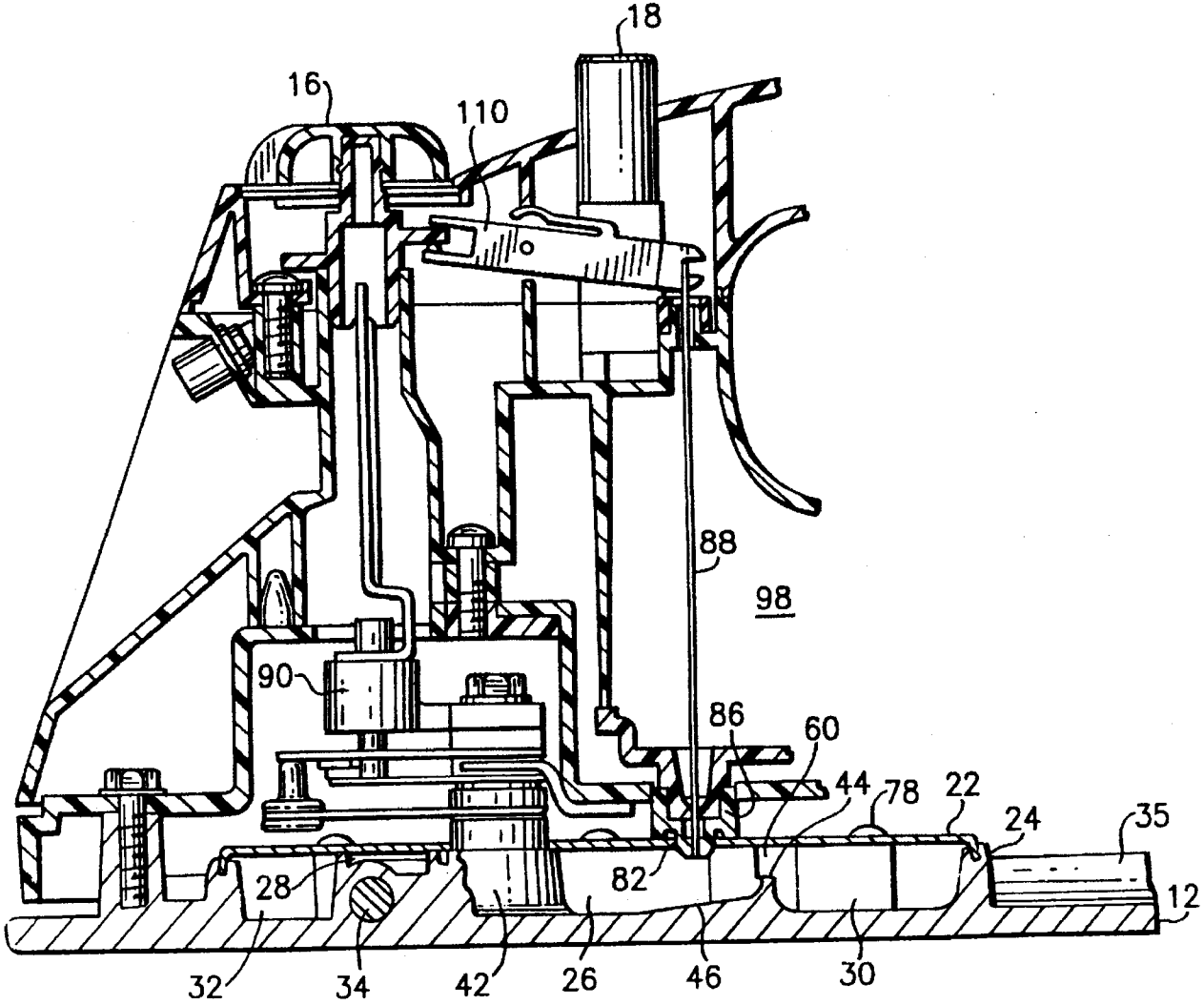
FIG. 3 is a partial cross-sectional view of the front of the iron shown in FIG. 1 taken along line 3—3.

The iron 10 generally comprises a soleplate 12, a housing 14, a temperature control knob 16, and a spray button **18*a* and a surge button 18*b*. Referring also to FIG. 2 a top plan view of the front of the soleplate 12 is shown. The soleplate has a raised wall 24 in a general triangular shape that forms the side walls for the steam chamber 20. A cover 22 (see FIG. 4) is attached to the top of the wall 24 to form the top of the steam chamber. Referring also to FIG. 3, the steam chamber 20 has four areas or chambers; a primary steam generating area 26, a surge steam generating area 28, a rear chamber 30, and a steam distribution chamber 32**.

Located in the soleplate 12 is a heating element 34 that has a general "U" or "V" shape at the steam chamber 20. The heating element 34 is encased in the soleplate, except at the rear end of the soleplate where electrical connections are made. Thus, a general raised ridge 35 is formed in the soleplate 12 in which the heating element 34 is located. Extending upward from the top of the soleplate in the steam chamber 20 are three walls 36, 38 and 40. A thermostat mounting boss 42 also extends upward at the primary steam generating area 26. The first wall 36 surrounds the primary steam generating area 26 and the boss 42. The wall 36 has an open rear end with a low raised lip 44. The top surface of the soleplate 12, in the primary steam generating area 26, has a ramp 46 that is inclined towards the lip 44. The wall 36 also has ribs 48 extending outward from the wall 36.

The second wall 38, generally surrounds the first wall 36. The first and second walls 36, 38 establish the inner and outer sides of the surge steam generating area 28. The second wall 38 has inwardly projecting ribs 50, a side pocket 52, and spaced rear fins 54. Located in the front 28*a* of the surge steam generating area 28 is a recess or pocket 92. The front left rib 48*a* also has a longer length than the rest of the ribs 48. The rear fins 54 extend into the rear chamber 30. The third wall 40 comprises two spaced wall sections 56, 57. All three walls 36, 38, 40 are located predominantly at the inner and outer sides of the raised ridge 35. The open rear end of the primary steam generating area 26 at the raised lip 44 forms the steam exit 60 from the primary area 26 into the rear chamber 30. The surge steam generating area 28 has two exits 62, 64 located on opposite sides of the primary area exit 60. The two surge steam generating area exits 62, 64 also exit into the rear chamber 30.

Located on opposite sides of the rear chamber 30 are the wall sections 56, 57 and the rear fins 54 of the second wall 38. Two exits 66, 68 are formed between the pairs of fins and wall sections from the rear chamber 30 to the steam distribution chamber 32. The tops of the raised ridge 35 are flat at the rear chamber exits 66, 68 to compensate for possible mineral deposit build-up. The fins 54 are spaced from the raised ridge 35 to form areas 70 which are also provided to compensate for possible mineral deposit build-up. The steam distribution chamber 32 generally surrounds the steam generating areas 26, 28 and the rear chamber 30. The steam distribution chamber 32 has holes 72 that extend to the bottom surface of the soleplate 12 to allow steam to exit from the steam chamber 20.

Figure 4:
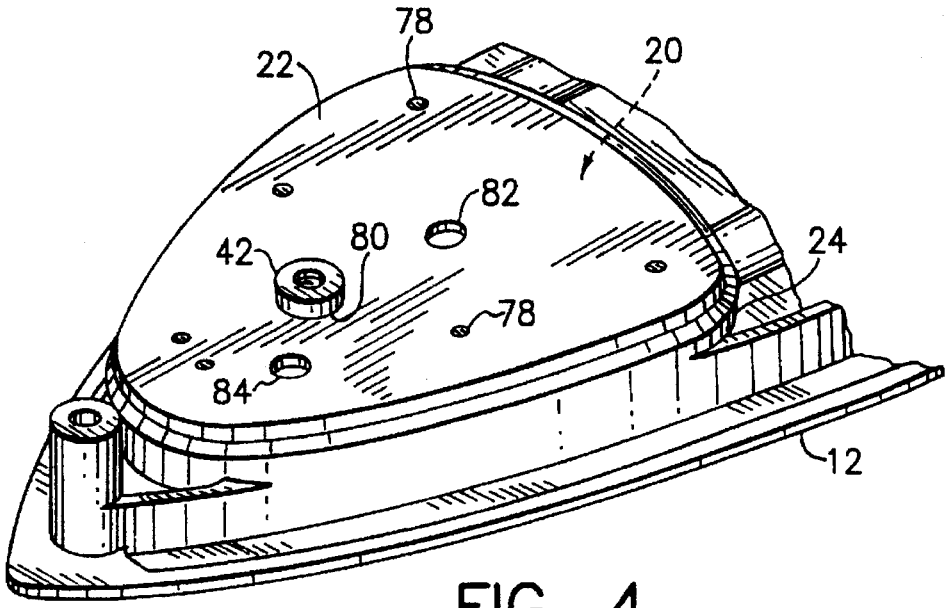
FIG. 4 is a perspective view of the front of the soleplate with the cover attached.

Referring now also to FIG. 4, the front of the soleplate 12 is shown with the steam chamber cover 22 attached. The soleplate 12 has rivet sections 78 that extend through rivet holes in the cover and are deformed to attach the cover 22 to the soleplate 12. The perimeter of the cover 22 is sealed with the top of the raised wall 24. The cover 22 also has three other holes 80, 82, 84. The first hole 80 has the top of the thermostat boss 42 extending therethrough. The second hole 82 is an entrance into the primary steam generating area 26. The third hole 84 is an entrance into the surge steam generating area 28. As seen in FIG. 3, located in the second hole 82 is a valve 86. The second hole 82 and valve 86 are located directly above the ramp 46. The valve 86 has a valve rod 88 that is moved by the temperature control knob 16 as described in U.S. patent application Ser. No. 08/512,852, filed Aug. 9, 1995, which is hereby incorporated by reference in its entirety. Mounted on the thermostat boss 42 is the thermostat 90.

The third hole 84 is located offset from the centerline of the soleplate 12. In particular, the third hole 84 is located above point P in the surge steam generating area 28. Point P is offset from the centerline of the soleplate and is located at the side pocket 52 in front of the rib 48*a*. The side pocket 52 is provided to accommodate the third hole 84 such that the second wall 38 does not pass directly under the third hole 84. Thus, the third hole 84 opens only into the surge steam generating area 28.

Figure 5:
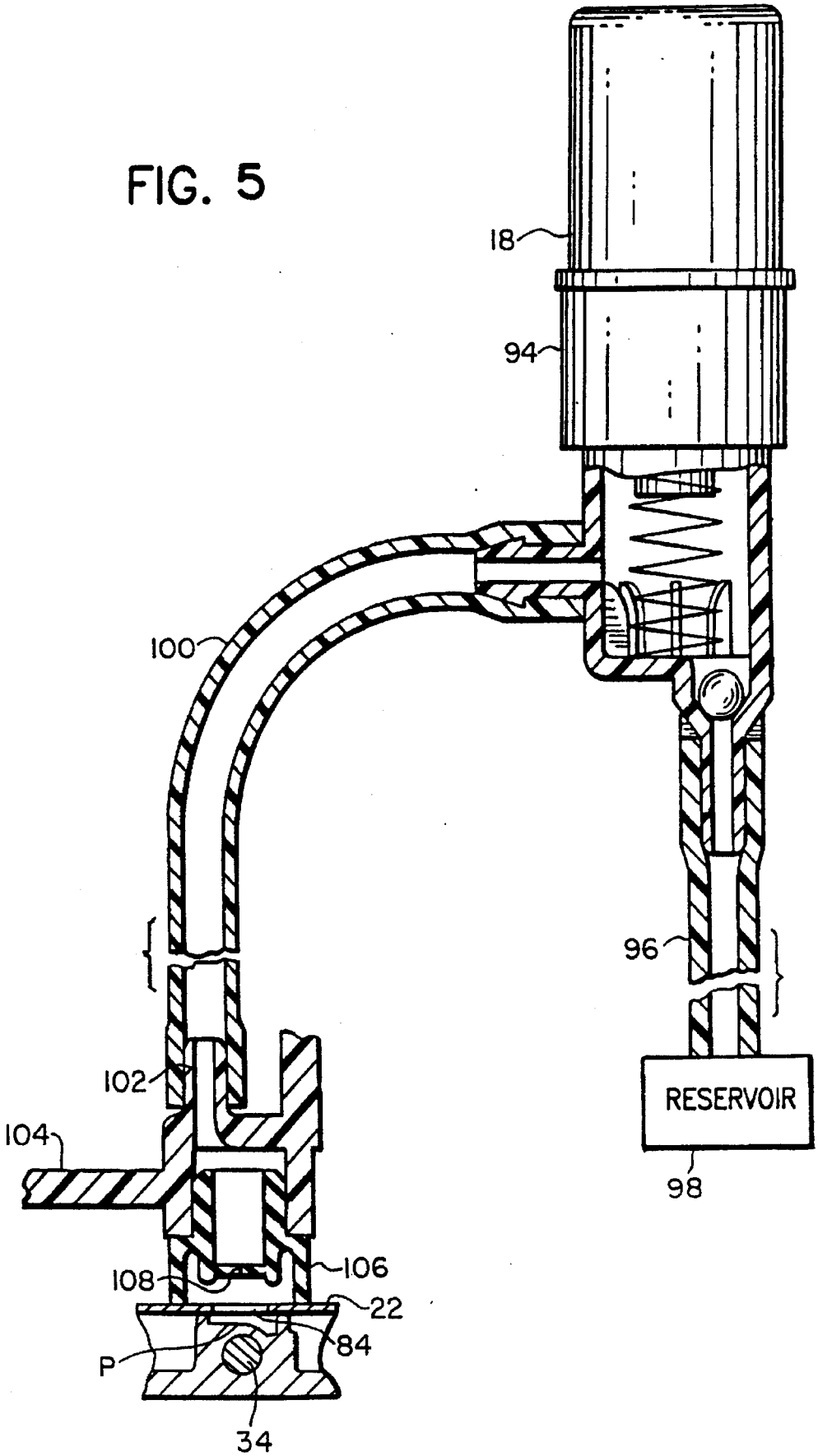
FIG. 5 is a partial schematic cross-sectional view of the surge steam water delivery system used in the iron shown in FIG. 1.

Referring also to FIG. 5, there is shown a schematic cross-sectional view of the surge steam system for delivering water into the surge steam generating area 28 at the entry point P. The system includes a pump 94 under the surge steam button 18 (see FIG. 1), a conduit 96 connected to the water reservoir 98, a conduit 100 connected to a boss 102 on the skirt 104, and a seal 106 between the skirt 104 and the cover 22. The seal 106 has a slit 108 therein. This water delivering system is described in U.S. patent application Ser. No. 08/529,939, filed Oct. 18, 1995, which is hereby incorporated by reference in its entirety. When the surge steam button 18 is pumped, water is delivered from the reservoir 98 through the third hole 84 and onto the entry point P above the heating element 34.

Primary steam generation and surge steam generation will now be described. Referring to FIG. 3, when the user rotates the temperature control knob 16 to a predetermined position, the rocker 110 lifts the valve rod 88 up from the valve 86 to open a path from the water reservoir 98, through the second hole 82, and into the primary steam generating area 26 on the ramp 46.

The ramp 46 guides any water that is not immediately vaporized towards the thermostat mounting boss 42. By directing water towards the boss 42, the thermostat 90 is effected to supply power or stop the supply of power to the heating element 34. More specifically, water around the boss 42 will lower the temperature of the boss 42 which will cause the thermostat 90 to turn on. Thus, the ramp 46 assists in controlling the cycling of the thermostat to increase heat in the primary steam generating area 26 when needed because of water delivery into the area 26. The lip 44 at the exit 60 also helps to contain water inside the area 26 and functions as a baffle between the area 26 and the rear chamber 30. Most of the primary water to steam conversion takes place in the primary steam generating area 26. However, some water to steam conversion may occur in the rear chamber 30, such as when the iron is tilted up or set on its heel rest.

Referring to FIGS. 2 and 3, when the user pushes the surge steam button 18, water is delivered at the entry point P above the heating element 34. As noted above, the entry point P is located offset from the centerline of the soleplate. This was done because of the location of the thermostat 90 in the front center of the soleplate and the limited amount of space. Depositing water for surge steam generation directly onto the raised ridge 35 that the heating element 34 is located in provides the fastest means for generating steam. However, it has been discovered that excessive pressure from steam generation resulted from this direct deposit above the heating element. This pressure pulse could cause water to leak or be pushed between the wall 38 and the cover 22 directly into the steam distribution chamber 32 and out the holes 72. This type of water leakage can cause water spotting on some types of clothing. To avoid the pressure pulse water spotting problem the pocket or recess 92 has been provided directly adjacent to the water entry point P to function as a pressure accumulator or dampener. In order to maximize the conversion of water into steam, it is desirable to have flow balanced along the surge steam generating area 28 and out the two exits 62, 64. Because the lengths of the surge steam generating area on opposite sides of the entry point P are not the same, the length of the front left rib 48*a* is selected to form a restricted flow gap 112 to balance the flow through the opposite sides of the area 28 and out the two exits 62, 64. The gap 112 is thus tuned so that water flows equally along the two sides 28*b*, 28*c* of the surge passage. Again, this balancing by the rib 48*a* and gap 112 is to account for the offset water entry point P. The ribs 48, 50 help to separate water from steam.

The two exits 62, 64 from the surge steam generating area 28 allow surge steam to exit on opposite sides and behind the exit 60 and directly into the rear chamber 30. Separation of the surge exits 62, 64 from the exit 60 is intentionally done to prevent fast moving surge steam from entraining or carrying water from the primary steam generating area 26 with the surge steam which could otherwise cause water spotting problems.

Most steam iron designs utilize a very large boiler area with long surge passages to obtain acceptable levels of surge performance without water spotting. These designs usually have the surge point located directly above a deep pocket well to act as a pressure accumulator. One of the advantages of the present design is that it provides comparable surge performance to competitive irons which have much larger boiler areas. In addition, the soleplate is of very low weight which has some cost advantages. The iron 10 has a compact design. Due to this compact design and locations of the thermostat and water tank, it was necessary to locate the surge water entry directly on top of the heating element and offset from the centerline of the soleplate. In order to prevent excessive pressure at this location (which can cause water to leak past the walls) a pocket is molded directly adjacent to the water entry point to act as a pressure accumulator or dampener to help reduce the tendency for water spotting. In order to maximize the conversion of water into steam, it is generally desirable to have the water flow "balanced" along the surge passages. This is accomplished with the flow balancing rib 48*a* which can be tuned to allow the proper gap for equal water flow along both sides of the surge passage.

In "normal" steam ironing mode, the water drop is located in the main chamber 26 directly in front of the baffle 44. The ramp 46 is used to channel the water towards the thermostat boss 42 to control the cycling of the thermostat. Thus, most of the steam/water conversion is taking place in the primary boiler chamber 26 during normal ironing. When the surge is activated, the flow is channeled into the rear chamber before exiting over the heating element and out the soleplate vents. This is important because it prevents water in the primary boiler chamber 26 from being carried through to the rear chamber when the surge is activated. The baffling used in the surge passages by the ribs 48, 50 maximizes the travel distance before exiting the soleplate to reduce the tendency for water spotting. Although the tops of the walls 36, 38, 40 preferably normally contact the bottom of the cover 22, in a preferred embodiment the first wall 36 is slightly lower than the second wall 38 such that if pressure in the surge steam generating area 28 becomes excessive, a path between the top of the first wall 36 and the cover 22 will open before a path between the top of the second wall 38 and the cover 22 opens. Flow will seek the path of least resistance between the top of the first wall 36 and the cover 22 rather than the second wall 38 and the cover 22. This will also help to prevent water spotting problems. The two level rib height also helps to compensate for slight manufacturing defects in the soleplate. For example, defects such as small bumps, molding flash, warpage, etc. on top of the first wall 36, because the first wall 36 is lower than the second wall 38, will not cause a gap to be opened between the second wall 38 and the cover 22. Flow from excess pressure will occur between the first wall 36 and the cover 22 before it occurs between the second wall 38 and the cover 22. Again, this helps to prevent water spotting.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In an electric steam iron having a soleplate with a heating element, a water reservoir, and means for depositing water from the reservoir onto the soleplate at a first location for ordinary steam generation and at a second location for surge steam generation, wherein the improvement comprises:

the soleplate having a first primary steam generating area with the first location thereat and a substantially separate second surge steam generating area, said second surge generating area including a relatively narrow cross-sectional area channel, the second location being located in the channel of said second surge steam generating area above the heating element, the second surge steam generating area including a recessed pocket next to the second location for dampening pressure from steam generation at the second location, said recessed pocket comprising a relatively wide cross-sectional area portion having an inlet in fluid flow communication with a first length of said channel and an outlet in fluid flow communication with a second length of said channel.

2. An iron as in claim 1 wherein the second surge steam generating area has a general "U" shape.

3. An iron as in claim 2 wherein the second surge steam generating area is located above and along the heating element.

4. An iron as in claim 1 wherein the second location is located at a non-centered position along the length of the second surge steam generating area.

5. An iron as in claim 4 wherein the second steam generating area has a balancing rib on a first side of the second location that partially restricts flow of water and steam therepast such that steam exits two exits on opposite ends of the second area in a substantially uniform manner.

6. An iron as in claim 1 wherein the second surge steam generating area substantially surrounds the first primary steam generating area.

7. An iron as in claim 6 wherein the first and second areas have rear ends with separate exits into a rear chamber and the rear chamber has passages to a steam distribution chamber wherein the steam generated in the first and second areas must pass through the rear chamber before exiting the iron through the steam distribution chamber.

8. An iron as in claim 7 wherein the soleplate has a raised lip between the first primary steam generating area and the rear chamber.

9. An iron as in claim 8 wherein the primary steam generating area has an inclined bottom surface for directing water away from the raised lip.

10. A surge steam generation system in an electric steam iron comprising:

an elongate surge steam generating path located above and along a heating element of the iron, the path having two exits; and a balancing rib extending partially across the path on a first side of an entry point of water into the path, the entry point of the water being located at a non-centered position of the length of the path such that a length of the path on the first side of the entry point is shorter than a length of the path on an opposite second side of the entry point, the rib being suitably sized, shaped and positioned relative to the entry point to control flow of water and steam therepast such that steam exits the two exits substantially uniformly.

11. A system as in claim 10 wherein the path substantially surrounds a first primary steam generating area.

12. A system as in claim 11 wherein the path and the first area have separate exits at their rear ends into a rear chamber and the rear chamber has passages to a steam distribution chamber wherein the steam generated in the path and in the first area must pass through the rear chamber before exiting the iron through the steam distribution chamber.

13. A system as in claim 10 wherein the path has a general "U" shape.

14. A system as in claim 10 wherein the path is located above and along the heating element.

15. A system as in claim 10 further comprising a recessed pocket next to the entry point for dampening pressure from steam generation at the entry point.

16. A soleplate for an electric steam iron comprising:

a first steam generating chamber for generating primary steam;

a separate second steam generating chamber substantially surrounding the first chamber, the second chamber having a general "U" shape and being located above and along a portion of a heating element in the soleplate for generating surge steam;

a steam distribution chamber substantially surrounding the second chamber having holes extending through the soleplate to a bottom surface of the soleplate; and a third steam generating chamber connecting the first and second steam generating chambers to the steam distribution chamber, said third steam generating chamber being located behind the first and second chambers, with the first and second chambers having separate exits into the third chamber.

17. A soleplate as in claim 16 wherein the second chamber includes a recessed pocket next to an entry point of water into the second chamber.

18. A soleplate as in claim 16 wherein the soleplate has a raised lip between the first chamber and the fourth chamber and an inclined bottom surface in the first chamber towards the raised lip.

19. An electric steam iron comprising:

a soleplate; and a thermostat connected to a boss on the soleplate, wherein the soleplate has a primary steam generating area with the boss being located, at least partially, in the primary steam generating area, a bottom surface of the primary steam generation area having an inclined section such that water deposited into the primary steam generation area is directed towards the boss for controlling cycling of the thermostat.

20. An iron as in claim 19 wherein the soleplate further comprises a surge steam generating area located above and along a heating element in the soleplate, the surge steam generating area substantially surrounding the primary steam generating area.

21. An iron as in claim 20 wherein the soleplate further comprises a rear chamber located behind the primary and surge steam generating areas.

22. An iron as in claim 21 wherein the soleplate has a raised lip partially separating the primary area from the rear chamber.

* * * * *